US010052521B1

(12) United States Patent
Mumford

(10) Patent No.: US 10,052,521 B1
(45) Date of Patent: Aug. 21, 2018

(54) SELF-ADVANCING KNEE ASCENDER

(71) Applicant: Richard Dean Mumford, Acworth, GA (US)

(72) Inventor: Richard Dean Mumford, Acworth, GA (US)

( * ) Notice: Subject to any disclaimer, the term of this patent is extended or adjusted under 35 U.S.C. 154(b) by 23 days.

(21) Appl. No.: 15/166,219

(22) Filed: May 26, 2016

Related U.S. Application Data

(60) Provisional application No. 62/166,449, filed on May 26, 2015.

(51) Int. Cl.
*A63B 27/02* (2006.01)
*A63B 29/02* (2006.01)

(52) U.S. Cl.
CPC ..... *A63B 27/02* (2013.01); *A63B 29/02* (2013.01)

(58) Field of Classification Search
CPC ..... A63B 27/00; A63B 29/00; A63B 27/02; A63B 27/04; A63B 29/02; A63B 29/028
See application file for complete search history.

(56) References Cited

U.S. PATENT DOCUMENTS 3,718,945 A * 3/1973 Brindejonc de Treglode ..... B29C 47/027 24/370
4,036,101 A * 7/1977 Burnett ..... D04C 1/12 294/74
4,093,292 A * 6/1978 Marcet ..... B66C 1/12 294/74
4,850,629 A * 7/1989 St. Germain ..... B66C 1/12 294/74
5,727,833 A * 3/1998 Coe ..... B66C 1/12 294/74
7,036,780 B1 * 5/2006 Geninatti ..... A63B 29/02 114/230.1
7,637,549 B2 * 12/2009 Hess ..... B66C 1/18 294/74
9,296,593 B2 * 3/2016 Yale ..... B66C 1/12
9,643,054 B2 * 5/2017 Frankhauser ..... A63B 27/02
(Continued)

FOREIGN PATENT DOCUMENTS

WO WO 2014/182721 A1 11/2014

OTHER PUBLICATIONS

"Beranek Rope Walker Knee Ascender", item No. CLI345 in WesSpur Tree Equipment's online catalog, on the Internet at http://www.wesspur.com/items/cli345.html. Webpage from Sep. 23, 2015.

*Primary Examiner* — Katherine W Mitchell
*Assistant Examiner* — Shiref M Mekhaeil
(74) *Attorney, Agent, or Firm* — Ramberg IP, LLC

(57) ABSTRACT

A self-advancing knee ascender featuring:
a piece of webbing;
at least two lengths of tubing encased by the piece of webbing;
a second piece of webbing attached to the appropriate middle of the at least two lengths of tubing, wherein the second piece of webbing includes a first end and a second end, wherein the first end is arranged to form a webbing loop;
a first linking mechanism removably attached to the webbing loop;
a mechanical ascender attached to the second end of the second piece of webbing;
a cord having a first end and a second end, wherein the cord is inside the at least two lengths of tubing, wherein the cord exits one tube, forms a cord loop, and enters another tube; and
a second linking mechanism attached to the cord loop.

11 Claims, 4 Drawing Sheets

(56) References Cited

U.S. PATENT DOCUMENTS

| | | | | |
|---|---|---|---|---|
| 2013/0133981 | A1* | 5/2013 | Spraggon | A63B 27/02<br>182/134 |
| 2014/0070557 | A1* | 3/2014 | Mozsgai | B66C 1/12<br>294/74 |
| 2015/0251057 | A1* | 9/2015 | Frankhauser | A63B 29/02<br>182/134 |
| 2016/0059080 | A1* | 3/2016 | Frankhauser | A62B 1/14<br>182/134 |
| 2016/0220857 | A1* | 8/2016 | Rappoport | A62B 35/0075 |

* cited by examiner

SELF-ADVANCING KNEE ASCENDER

CROSS-REFERENCE TO RELATED APPLICATION

This patent document claims the benefit of U.S. Provisional Application Ser. No. 62/166,449, filed May 26, 2015 in the name of Richard Dean Mumford. The entire contents of this commonly owned provisional application are expressly incorporated by reference herein.

STATEMENT REGARDING U.S. FEDERALLY SPONSORED RESEARCH

None.

BACKGROUND OF THE INVENTION

The present invention relates to rope ascending accessories and, more particularly, to a self advancing knee ascender.

The problem with a knee ascender is that it needs to be connected above with a bungee cord to assist in the recoil of the knee ascender up and down the rope as a climber walks up the rope. The knee ascender must be connected to the foot but not at the same level as the foot ascender to allow a walking step to be taken without the knee or foot ascender colliding. It is a problem to get a bungee cord that stretches enough and is strong and long enough to recoil the knee ascender efficiently. Current devices are made by installing bungee inside of a rope by splicing. The bungee is subject to failure and wear. To replace the bungee the rope must be un-spliced by the manufacturer. Because a single length of bungee is used it is weaker and more susceptible to breakage and wear.

As can be seen, there is a need for a self advancing knee ascender.

SUMMARY OF THE INVENTION

What is provided in accordance with the present invention is a self-advancing knee ascender that includes:

- a web member;
- at least two lengths of tubing, encased by the web member;
- the web member including a first end and a second end, wherein the first end is arranged to form a web loop;
- a first linking mechanism removably attached to the web loop;
- a mechanical ascender attached to the second end of the web member;
- a cord having a first end and a second end, wherein the cord is inside the at least two lengths of tubing, wherein the cord exits one tube, forms a cord loop, and enters another tube; and
- a second linking mechanism attached to the cord loop.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a self advancing knee ascender comprising: a piece of webbing; at least two lengths of tubing encased by the piece of webbing; a second piece of webbing attached to the approximate middle of the at least two lengths of tubing, wherein the second piece of webbing comprises a first end and a second end, wherein the first end forms a loop; a linking mechanism removably attached to the loop; a mechanical ascender attached to second end of the second piece of webbing; a cord having a first end and a second end, wherein the cord is inside the at least two lengths of tubing, wherein the cord exits one tube, forms a loop, and enters another tube; and a second linking mechanism attached to the first end of the cord.

DETAILED DESCRIPTION OF THE INVENTION

Figure 1:
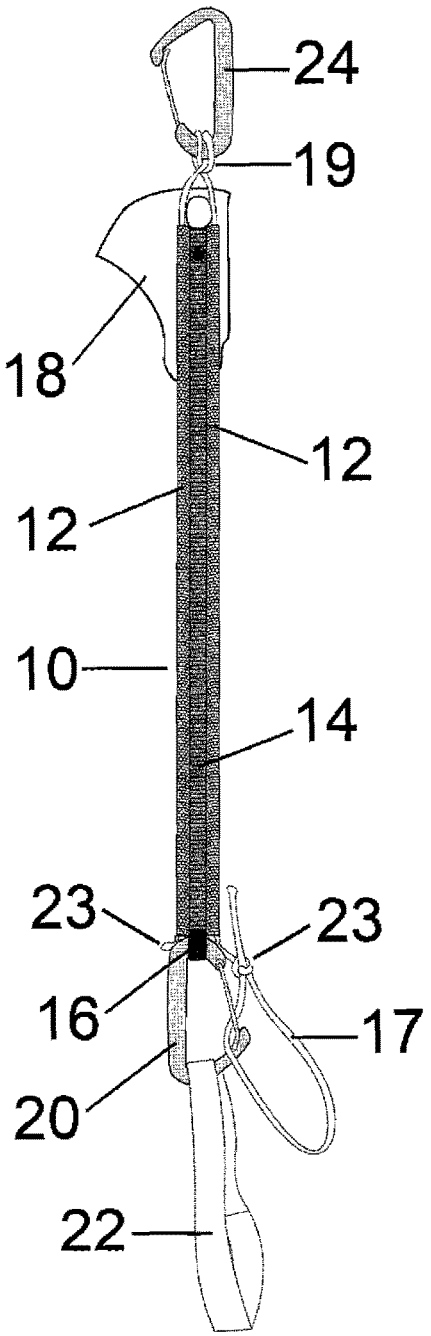
FIG. 1 is a side view of an exemplary embodiment of the present invention.
Figure 2:
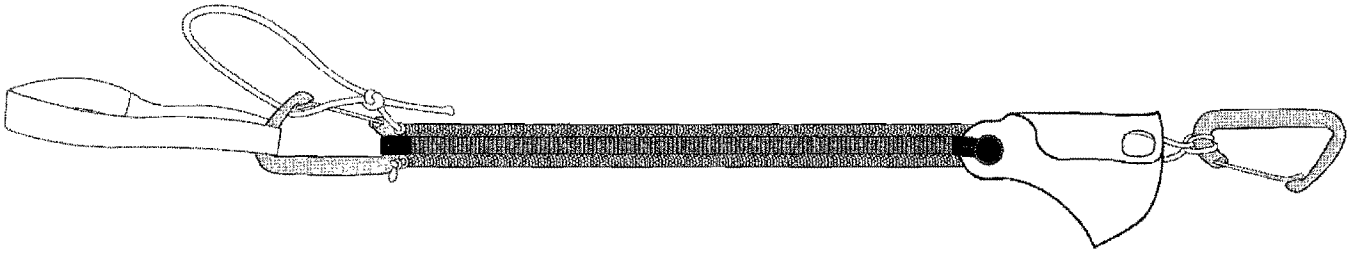
FIG. 2 is a side view of an exemplary embodiment of the present invention.
Figure 3:
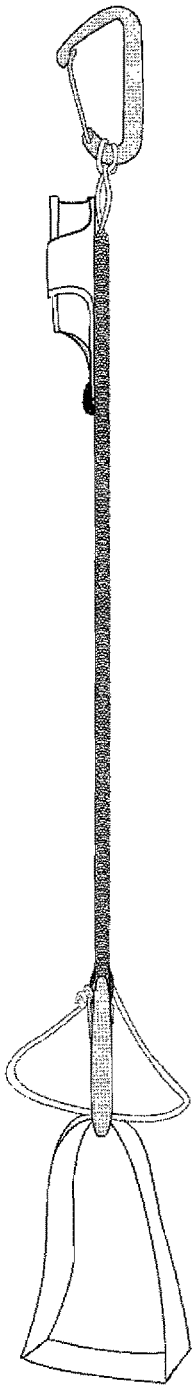
FIG. 3 is a side view of an exemplary embodiment of the present invention.
Figure 4:
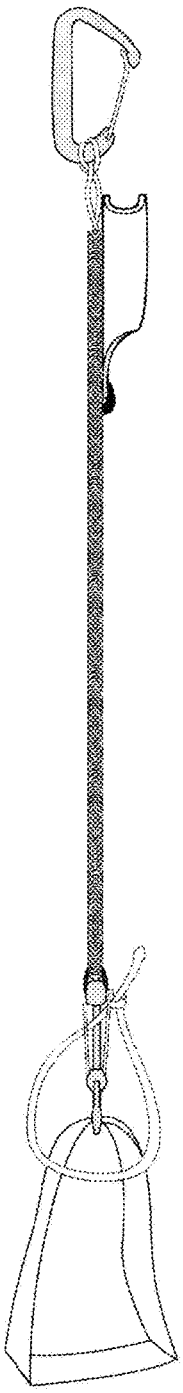
FIG. 4 is a side view of an exemplary embodiment of the present invention.

As is illustrated in FIGS. 1 through 4, a self advancing knee ascender may include a piece of webbing 10. At least two lengths of tubing 12 may be encased by the piece of webbing 10. The at least two lengths of tubing 12 may be made from a semi rigid plastic material or the like. The piece of webbing 10 may be folded, glued, sewn, or the like, in order to encase the at least two lengths of tubing 12. A second piece of webbing 14 may be attached to the approximate middle of the at least two lengths of tubing 12. The second piece of webbing 14 may include a first end and a second end. The first end of the second piece of webbing 14 may form a loop 16. A first linking mechanism, such as a carabineer 20 or the like, may be attached to the loop 16. A mechanical ascender 18 may be attached to the second end of the second piece of webbing 14. A cord 17 may be placed within the at least two lengths of tubing 12. The cord may be a bungee cord, shock cord or the like. The cord may be pulled inside of the at least two lengths of tubing 12. The cord may have a first end and a second end. The first end of the cord may be tied with stopper knots 23 or the like. The second end of the cord may form a loop 19 and exit through one length of tubing into another length of tubing. A second linking mechanism may attach to the first end of the cord. Alternatively, a second linking mechanism 24 may be attached to said loop 19.

The first linking mechanism may be clipped to a climber's boot by a foot loop 22, foot harness or the like. The connection between the foot and the ascender may be secured through this process. The ascender may be at about the height of the climber's knee. The cord at the top of the device may be stretched up and connected to a location near the center harness attachment on the climber's saddle. The ascender may be placed on a climbing line. When the climber lifts his foot, the whole device with a knee ascender may move up the rope being pulled up with the cord. At the top of the climber's step, when the climber may step down, the ascender may engage. The engagement of the ascender may allow the climber to place weight on that foot, enabling a step to be taken with the other foot that may have a foot ascender. A step may be taken with the foot ascender and then another with the knee ascender. This process may be repeated enabling the climber to walk up the rope.

It should be understood, of course, that the foregoing relates to exemplary embodiments of the invention and that modifications may be made without departing from the spirit and scope of the invention as set forth in the following claims.

What is claimed is:

1. A self-advancing knee ascender comprising:

A first piece of webbing;

At least two lengths of tubing, comprising a first tube and a second tube, wherein said first tube is arranged parallel to said second tube, and said at least two lengths of tubing being encased by said first piece of webbing;

A second piece of webbing attached to a middle section between said at least two lengths of tubing, wherein said second piece of webbing comprises a first end and a second end, wherein said first end is arranged to form a webbing loop;

A first linking mechanism removably attached to said webbing loop;

A mechanical ascender attached to said second end of said second piece of webbing;

A cord having a first end and a second end, wherein said cord is inside said at least two lengths of tubing, wherein said cord exits said first tube, forms a cord loop, and enters said second tube; and A second linking mechanism attached to said cord loop.

2. The self-advancing knee ascender of claim 1, wherein said first piece of webbing is arranged to encase said at least two lengths of tubing by at least one of folding, sewing, or gluing.

3. The self-advancing knee ascender of claim 1, wherein said first linking mechanism is arranged to releasably receive an apparatus.

4. The self-advancing knee ascender of claim 1, wherein said first linking mechanism is arranged to releasably receive at least one of a foot harness or a foot loop.

5. The self-advancing knee ascender of claim 1, wherein said cord comprises at least one of a bungee cord and a shock cord.

6. The self-advancing knee ascender of claim 1, wherein said cord is arranged to be attached to a user.

7. The self-advancing knee ascender of claim 1, wherein said cord is arranged to be attached to a user with said second linking mechanism.

8. A self-advancing knee ascender comprising:

A first piece of webbing;

At least two lengths of tubing, comprising a first tube and a second tube, wherein said first tube is arranged parallel to said second tube, and said at least two lengths of tubing being encased by said first piece of webbing;

A second piece of webbing, wherein said second piece of webbing comprises a first end and a second end, wherein said first end is arranged to form a webbing loop;

A first linking mechanism removably attached to said webbing loop;

A mechanical ascender attached to said second end of said second piece of webbing;

A cord having a first end and a second end, wherein said cord is inside the at least two lengths of tubing, wherein said cord exits said first tube, and enters said second tube thereby forming a cord loop; and A second linking mechanism attached to said cord loop.

9. The self-advancing knee ascender of claim 8, wherein said first piece of webbing is arranged to encase said at least two lengths of tubing by at least one of folding, sewing, or gluing.

10. The self-advancing knee ascender of claim 8, wherein said first linking mechanism is arranged to releasably receive an apparatus.

11. The self-advancing knee ascender of claim 8, wherein said first linking mechanism is arranged to releasably receive at least one of a foot harness or a foot loop.

* * * * *